US006044577A

United States Patent [19]

Clark

[11] Patent Number: 6,044,577

[45] Date of Patent: Apr. 4, 2000

[54] SELF-VENTILATING FOOTWEAR

[75] Inventor: Gregory Clark, Weston, Conn.

[73] Assignee: Breeze Technology, Las Vegas, Nev.

[21] Appl. No.: 09/162,476

[22] Filed: Sep. 28, 1998

[51] Int. Cl.[7] ..... A43B 7/08; A43B 13/20

[52] U.S. Cl. ..... 36/3 B; 36/29

[58] Field of Search ..... 36/3 B, 29, 28, 36/3 R

[56] References Cited

U.S. PATENT DOCUMENTS

| | | |
|---|---|---|
| 1,660,698 | 2/1928 | Williams, Sr. . |
| 1,932,557 | 10/1933 | Meucci . |
| 2,086,790 | 7/1937 | Wroten . |
| 2,354,407 | 7/1944 | Shaks . |
| 2,442,026 | 5/1948 | Thompson, Jr. . |
| 2,604,707 | 7/1952 | Hicks . |
| 2,741,038 | 4/1956 | Eliassen . |
| 3,029,530 | 4/1962 | Eaton . |
| 3,284,930 | 11/1966 | Baldwin . |
| 3,331,146 | 7/1967 | Karras . |
| 3,973,336 | 8/1976 | Ahn . |
| 4,215,492 | 8/1980 | Sandmeier . |
| 4,445,284 | 5/1984 | Sakutori . |
| 4,602,441 | 7/1986 | El Sakkaf . |
| 4,610,099 | 9/1986 | Signori . |
| 4,654,982 | 4/1987 | Lee . |
| 4,776,110 | 10/1988 | Shiang . |
| 4,813,160 | 3/1989 | Kuznetz . |
| 4,835,883 | 6/1989 | Tetrault et al. . |
| 4,888,887 | 12/1989 | Solow . |
| 4,974,342 | 12/1990 | Nakamura . |
| 4,993,173 | 2/1991 | Gardiner . |
| 4,995,173 | 2/1991 | Spier . |
| 4,999,931 | 3/1991 | Vermeulen . |
| 4,999,932 | 3/1991 | Grim . |
| 5,010,661 | 4/1991 | Chu . |
| 5,068,981 | 12/1991 | Jung . |
| 5,195,254 | 3/1993 | Tyng . |
| 5,282,324 | 2/1994 | Cheng . |
| 5,333,397 | 8/1994 | Haush . |
| 5,341,581 | 8/1994 | Huang . |
| 5,408,760 | 4/1995 | Tse et al. . |
| 5,477,626 | 12/1995 | Kwon . |
| 5,515,622 | 5/1996 | Lee . |
| 5,588,226 | 12/1996 | Schenkel . |
| 5,606,806 | 3/1997 | O'Dwyer . |
| 5,675,914 | 10/1997 | Cintron . |
| 5,697,170 | 12/1997 | Murrell et al. . |

FOREIGN PATENT DOCUMENTS

| | | |
|---|---|---|
| 579284 | 7/1959 | Canada . |
| 350103A2 | 1/1990 | European Pat. Off. . |
| 925961 | 9/1947 | France . |
| 2670369 | 6/1992 | France . |
| 118546 | 6/1990 | Germany . |
| 532953 | 9/1955 | Italy . |
| 2019194 | 10/1979 | United Kingdom . |
| 2165439 | 4/1986 | United Kingdom . |
| 2189679 | 11/1987 | United Kingdom . |
| 2240254 | 7/1991 | United Kingdom . |
| 2245145 | 1/1992 | United Kingdom . |
| WO 87/03789 | 7/1987 | WIPO . |
| WO 93/09994 | 5/1993 | WIPO . |

OTHER PUBLICATIONS

Japanese Patent Abstract of Japanese Patent No. 2–283,296 to Chisso Corporation, published on Nov. 20, 1990.

Japanese Patent Abstract of Japanese Patent No. 3–001,805 to Hayabe, published on Jan. 8, 1991.

*Primary Examiner*—Ted Kavanaugh

*Attorney, Agent, or Firm*—Crowell & Moring LLP

[57] ABSTRACT

A unitary pumping chamber that removes excess heat and moisture from within the footwear to the footwear exterior. The pumping chamber displaces an approximate air volume of 100 cubic centimeters. The placement of the pumping chamber above the midsole but below the foot-enclosing upper allows tension forces generated from flexion of the foot to reinflate the pumping chamber without addition mechanical devices. In addition, the performance of the midsole is not affected because the pumping chamber is not embedded within the midsole.

24 Claims, 5 Drawing Sheets

SELF-VENTILATING FOOTWEAR

FIELD OF THE INVENTION

This invention relates to ventilated footwear having a pumping chamber in the heel of the shoe.

BACKGROUND OF THE INVENTION

Ventilation, i.e., the removal of excess heat and moisture from within the footwear, is one of the few areas where performance of modern footwear that remains unsatisfactory. Although there is an extensive prior art concerning the forced air ventilation of footwear, typical forced air ventilation systems are costly and difficult to manufacture, have poor durability, or are otherwise incapable of circulating a sufficient amount of air to cool the wearer's foot effectively.

To reduce the cost and difficulty in footwear having a forced air ventilation system, improvements have been proposed in which the entire ventilation system is incorporated in a removable insole. Such ventilating insoles are disclosed in U.S. Pat. No. 3,331,146 (disclosing a chamber in the heel of an insole with duct leading into the front of foot and a second duct rising above the foot-enclosing upper); U.S. Pat. No. 4,776,110 (disclosing an insole with a chamber in the heel, multiple distribution channels, and an air guide for exchanging air through the side of the foot-enclosing upper); U.S. Pat. No. 5,068,981 (disclosing a heel chamber incorporating a mechanical spring and ducts configured to vent through the peripheral walls of the foot-enclosing upper); U.S. Pat. No. 5,195,254 (disclosing a molded insole and an assisting "blast device"); and U.S. Pat. No. 5,333,397 (disclosing a kidney-shaped air chamber position at the rear and inner periphery of the insole). Such insoles with ventilation system, however, have several intrinsic disadvantages such as:

(1) the volume of air that can be circulated by an insole device is severely limited by the thickness of the insole;

(2) the periodic compression of the insole pump requires the wearer's foot to move vertically relative to the interior sides of the footwear, resulting in friction, irritation, and possibly blisters;

(3) the re-circulation of the air contained within the footwear provides little long-term benefit, and the process itself may even cause the interior temperature to rise;

(4) insoles adapted to exchange air with the external environment are complex and often affect the design, manufacture, and aesthetic aspects of the footwear; and (5) the space and material limitations of the insole design result in a rapid degradation of their cushioning and air-pumping capabilities.

Another footwear ventilation system embeds the ventilation system in the sole structure of footwear with relatively thick, resilient midsole components. Examples include U.S. Pat. No. 1,660,698 (disclosing a cup-shaped cavity in the heel of footwear partially filled with a resilient material so as to form a toroidal pumping chamber); U.S. Pat. No. 3,973,336 (disclosing an air chamber in the heel of a footwear that is squeezed between the outsole and a press member when the footwear is flexed); U.S. Pat. No. 5,515,622 (disclosing an air bag in the heel of a footwear with a volume of about 20 cubic centimeters (cc)); U.S. Pat. No. 5,606,806 (disclosing a collapsible heel cavity with a volume of 75 cc); and U.S. Pat. No. 5,010,661 (dislosing a unidirectional ventilation sytem in which air is pumped into a cavity in the heel of the shoe, and then pumped out through outlets in the front part of the shoe).

All of these embedded systems provide some form of fluid connection between the system and the interior of the foot-enclosing upper via passages through the footbed and insole. Although placement of the ventilation system in the sole structure solves many of the problems inherent in the insole approach, it creates new problems as well. For example, there are still significant limitations on the amount of air that can be pumped. On one hand, a sole structure that is too stiff limits compression of air chamber and thereby restricts effective air circulation. One the other hand, a softer sole structure that enables air chamber compression provides little cushioning.

To solve the cushioning problems, additional components are often added to insure that the sole structure continues to perform all of its normal functions. For instance, additional modifications such as increasing the resilience of the air chamber, increasing the resilience of the surrounding materials, or adding a spring mechanism, are required to reinflate the air chamber. Another solution is to increase cushioning by restraining airflow within the ventilation system. This approach, however, reduces the cooling effect and increases energy losses and noise problems. Attempts to have both cooling and cushioning effect in a footwear have increased the complexity and cost of the ventilation system. Furthermore, the varying stiffness of the various components in a footwear often lead to local high-stress areas that cause components to breakdown and separate.

As described above, there is still an unsatisfied need for a footwear with a ventilation system that is inexpensive and easy to manufacture, and capable of pumping sufficient air to effectively cool the wearer's foot. The design of the ventilation system must also not compromise cushioning, durability, stability, and/or the aesthetic aspects of the footwear.

SUMMARY OF THE INVENTION

The present invention places a ventilation system at the most advantageous location within a footwear: between the foot-enclosing upper and the midsole. The present invention circulates more than 100 cc of air with each compression cycle of the pumping chamber, i.e. with each step or stride taken by the wearer of the footwear. Another feature of the present invention is that it is simple and inexpensive to manufacture, without compromising cushioning, durability, stability, and aesthetic aspects of the footwear.

The ventilation system of the present invention uses an air pumping chamber, an internal air duct connecting the pumping chamber and the footwear interior, an external air vent connecting the pumping chamber and the footwear exterior, a first one-way valve drawing warm, moist air from the footwear interior into the pumping chamber via the internal air duct, and a second one-way valve exhausting the air out of the pumping chamber to exterior via the external air vent.

In the present invention, the pumping chamber is advantageously located in the heel region of the footwear between the sole assembly and the foot-enclosing upper. The pumping chamber is not embedded in either the sole assembly or the foot-enclosing upper. The pumping chamber is generally wedge-shaped with its maximum thickness at the rear of the footwear and tapers forward to a minimum thickness in front of the heel but behind the flex zone at the ball of the foot. The pumping chamber has peripheral walls, consisting of the side and rear walls, that are convex in either an elbow-shaped or curved manner. This construction of the pumping chamber allows the pumping chamber to collapse fully (to a volume approaching zero) without significant structural resistance.

The pumping chamber is configured so as to provide little resistance to compression. Consequently, when the wearer places any weight on the heel of the footwear, even when standing stationary, the pumping chamber is collapsed. The pumping chamber reinflates automatically when the wearer flexes his foot to raise his heel off the ground. As the foot flexes, tension forces are exerted on the pumping chamber that is located between the foot-enclosing upper and the midsole: (1) an upward force is exerted on the upper surface of the pumping chamber due to the movement of the foot-enclosing upper away from the ground; and (2) a downward force is exerted on the lower surface of the pumping chamber due to the resilience of the midsole and outsole that tends to keep it in its normal, undeformed state. These tension forces allow the pumping chamber to reinflate completely. This ventilation system is capable of circulating more than 100 cc of air per cycle.

It is the object of the present invention to provide a footwear with an effective air ventilation system that is inexpensive and easy to manufacture, and capable of pumping sufficient amount of air to effectively cool the wearer's foot without compromising cushioning, durability, stability or the aesthetic aspects of the footwear.

DESCRIPTION OF THE DRAWINGS

FIG. 1-*a* is a schematic diagram of the longitudinal cross-section of another embodiment of the present invention showing the wedge shape of the pumping chamber.

FIG. 5-*b* illustrates the rotation of the convex peripheral walls as the pumping chamber comes to the collapsed position.

DESCRIPTION OF THE INVENTION

Figure 1:
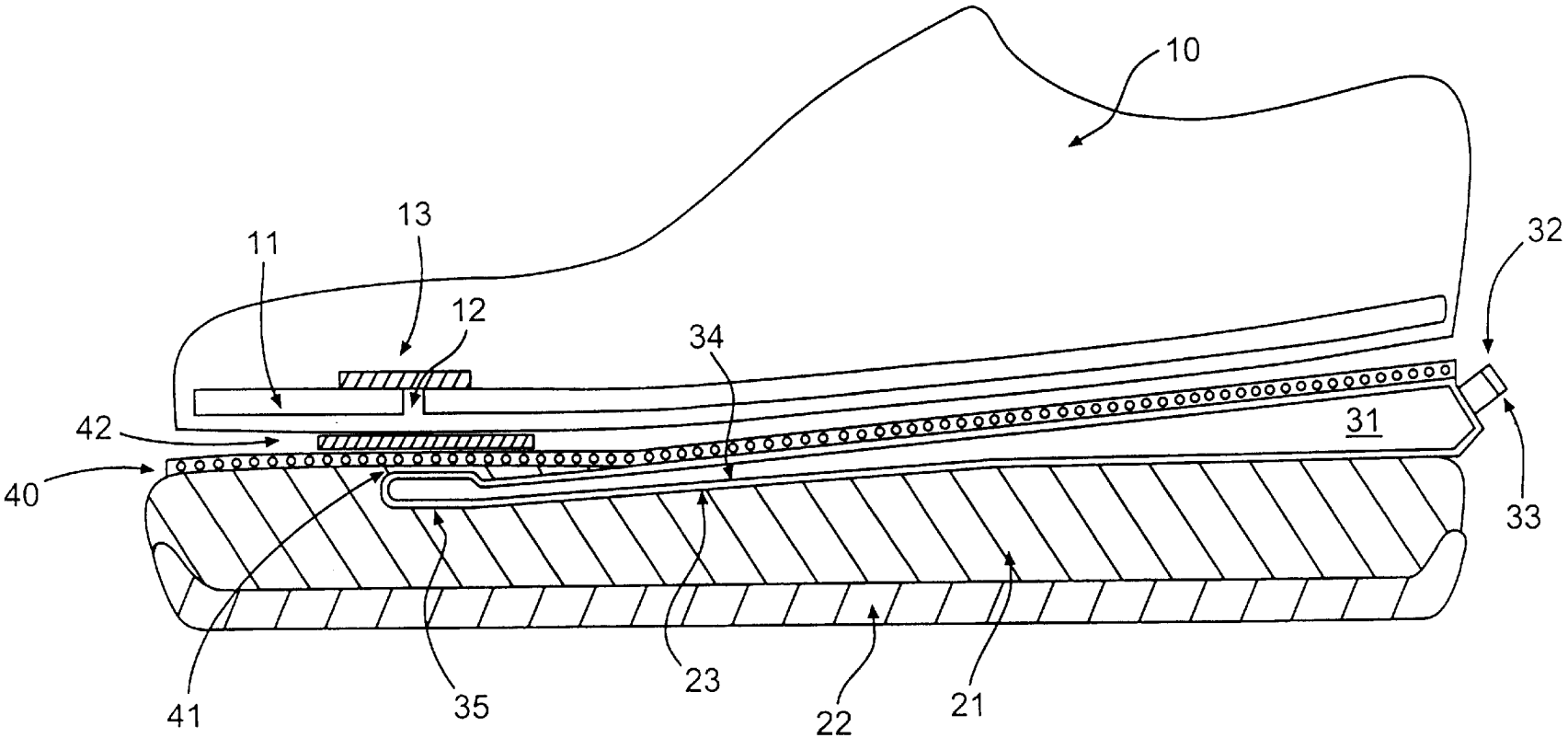
FIG. 1 is a schematic diagram of the longitudinal cross-section of a preferred embodiment of the present invention showing the wedge-shape of the pumping chamber, the convex nature of its rear wall, and its position between the foot-enclosing upper and the sole assembly that consists of a midsole and an outsole.
Figure 1A:
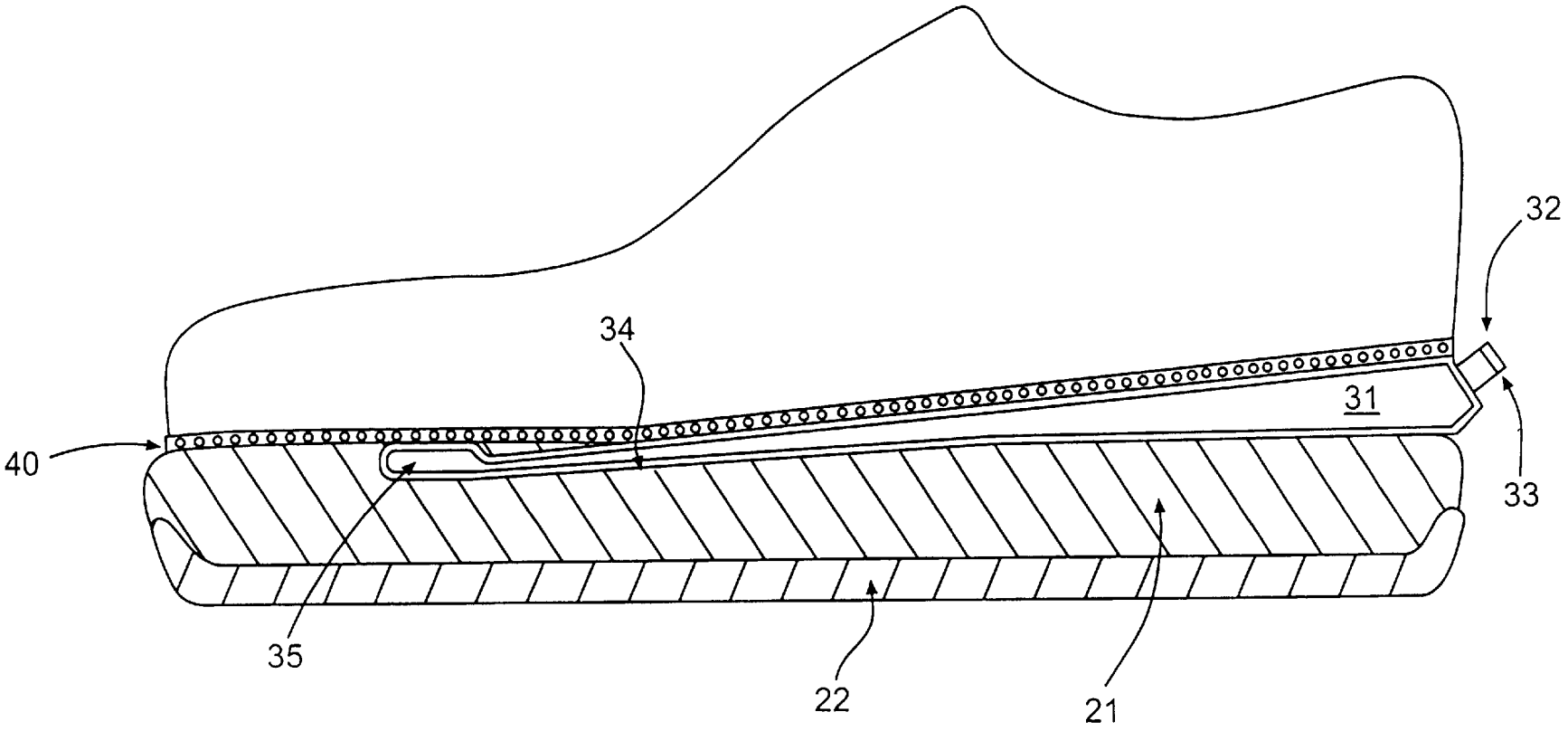

FIG. 1 is a schematic diagram of the side elevation of the present invention illustrating the preferred placement of the ventilation system components. The footwear has a foot-enclosing upper 10, a cushioning midsole 21, and a durable outsole 22. Pumping chamber 31 is advantageously positioned in the heel region of the footwear below foot-enclosing upper 10 but above midsole 21. As shown in FIG. 1, pumping chamber 31 is not embedded in either foot-enclosing upper 10 or midsole 21. In addition to pumping chamber 31, the ventilation system also has an external air vent 32 that fluidly connects pumping chamber 31 with the footwear exterior. External air vent 32 is equipped with a one-way valve 33 that allows air to flow out of pumping chamber 31 to the footwear exterior via external air vent 32. The ventilation system has an internal air duct 34 that fluidly connects pumping chamber 31 and the area generally under the toes. Internal air duct 34 is also equipped with a one-way valve 35 that allows air to flow into pumping chamber 31 from the footwear interior via the internal air duct 34.

Midsole 21 has a recess in its upper surface 23 to accommodate internal air duct 34. In a preferred embodiment, a lasting board 40 is inserted between upper 10 and pumping air chamber 31. A relatively stiff lasting board 40 is preferred as it serves to transmit downward compression and upward tension forces uniformly across the top surface of pumping chamber 31. Lasting board 40 may be formed from stiffened cardboard or from a sheet of a plastic such as polypropylene. Lasting board 40, if used, also can prevent sagging or cupping of pumping chamber 31 which would result in a decreased pumping efficiency. If lasting board 40 is used, then a vertical passage 41 is required to pass air through lasting board 40 and the footwear interior. A filtration device 42 such as an open cell foam or a mesh fabric may be placed across the entrance to passage 41 to prevent dirt from entering internal air duct 34.

A foam insole 11 may be placed inside foot-enclosing upper 10. If used, insole 11 will also require an air duct 12. A second filter 13 may be added to insole 11 to further protect the ventilation system from dirt.

Midsole 21 is typically formed from a 50 durometer polyurethane or ethylenevinyl acetate (EVA) foam. Pumping chamber 31, internal air duct 34, and external air vent 32 may be simply and inexpensively manufactured from similar EVA or polyurethane rubbers, and they can also be made in a single blow-molding operation. In a less preferred embodiment, pumping chamber 31 may be formed as a cavity in the foam of midsole 21.

In the preferred embodiment, placement of the ventilation system between midsole 21 and foot-enclosing upper 10 alleviates many of the problems associated with ventilation systems that are embedded within in the sole structure of the footwear. In the present invention, because pumping chamber 31 is below foot-enclosing upper 10, relative movement between foot-enclosing upper 10 and the wearer's foot is eliminated. Furthermore, because pumping chamber 31 is above midsole 21, effective air circulation is achieved because the collapse of pumping chamber 31 is unaffected by the stiffer material of midsole 21. In addition, cushioning and stability of the footwear are not compromised because midsole 21 functions without having a reduced thickness to accommodate pumping chamber 31. Furthermore, the unique placement of pumping chamber 31 does not affect the standard design of foot-enclosing upper 10 or outsole 22. It also do not complicate the standard design and fabrication techniques of these footwear components. Finally, the unique placement of pumping chamber 31 eliminates the delamination problems associated with multi-layer construction of ventilation systems disclosed in the prior art.

The wedge-shape of pumping chamber 31 contributes to its functionality. The flat upper and lower surfaces of pumping chamber 31 provide excellent bonding areas that are not subject to shear during normal running or walking. In addition, the flat surfaces of pumping chamber 31 are free of ridges or changes in hardness which could result in wearer discomfort.

In the preferred embodiment of the present invention, the length (longitudinal dimension) of pumping chamber 31 should be at least 30% of the length of the incorporating sole unit, i.e., extending from the rear extremity of the heel forward to about 30% of the length of the sole. The length of pumping chamber 31 should not be greater than 60% of the length of the sole to avoid the flex zone where most bending, kinking, and pinching actions occur.

In another embodiment of the present invention, the pumping chamber may be embedded in the midsole as shown in FIG. 1-*a*.

Figure 2:
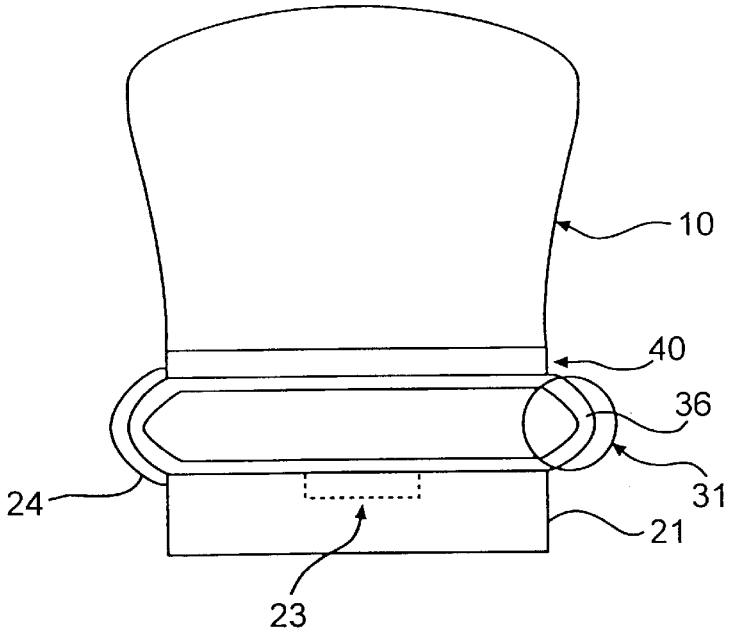
FIG. 2 is a schematic diagram of the rear elevation of the present invention further illustrating the placement of the pumping chamber and the convex nature of its sidewalls.
Figure 2A:
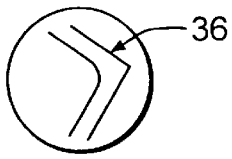
FIG. 2*a* is an enlarged view of the circled portion of FIG. 2 showing an elbow-shaped sidewall.
Figure 2B:
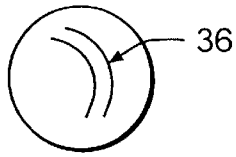
FIG. 2*b* is is an enlarged view of the circled portion of FIG. 2 showing a curved sidewall.
Figure 3:
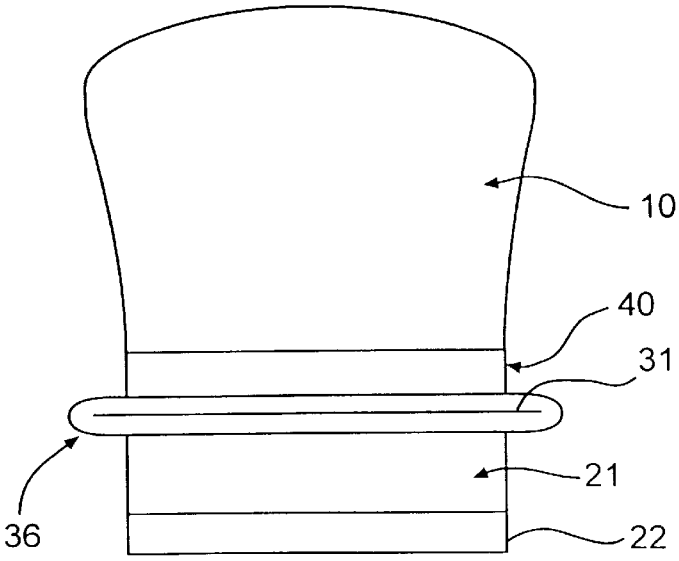
FIG. 3 illustrates the collapsed nature of the pumping chamber under normal loads.

FIG. 2 is a schematic diagram of the rear elevation of the present invention that further illustrates the unique placement of pumping chamber 31. As in FIG. 1, pumping chamber 31 is positioned between foot-enclosing upper 10 and midsole 21. FIG. 2 clearly shows that pumping chamber 31 is not embedded either in the heel of midsole 21 or within foot-enclosing upper 10. For cosmetic or manufacturing reasons it may be desirable to extend a thin layer of midsole material 24 around pumping chamber 31. The side and rear walls of pumping chamber 31 form peripheral walls 36 which may be colored or transparent, as desired, to provide an aesthetically pleasing appearance. Peripheral walls 36 of pumping chamber 31 are convex, either elbow-shaped or curved as shown in FIGS. 2-*a* and 2-*b,* respectively. Peripheral walls 36 fold as pumping chamber 31 collapses as shown in FIG. 3. A near complete collapse of pumping chamber 31 maximizes the volume of air circulated in the footwear. Typically, the volume of air pumped in and out of each step is in excess of 100 cc.

Peripheral walls 36 are configured to provide little resistance to the collapse of pumping chamber 31. Consequently, when the wearer places any weight on the heel of the footwear, even when standing stationary, pumping chamber 31 is fully collapsed as illustrated in FIG. 3. The folding of peripheral walls 36 is also shown in this figure. Since pumping chamber 31 is normally deflated when the wearer's foot is in contact with the ground, the footwear has a "normal" profile in use, i.e., the elevation of the wearer's heel is not higher or lower than it would be if the wearer were to wear a footwear without a pumping chamber. Stated in other words, midsole 21 has the same thickness as that of a similar footwear without the pumping chamber. Since pumping chamber 31 is not required to provide cushioning (which is provided by midsole 21), low restriction air valves can be used to minimize energy losses and noise.

The normally collapsed nature of the pumping chamber 31 also has significant biomechanical advantages. In prior art designs where air movement is the result of the compression of a chamber built into the midsole or the heel of a footwear, the wearer's heel drops below its normal resting position. The lowered heel position stretches the Achilles tendon more than normal. As a result, the probability of tendonitis and more serious injuries is increased. The lowered heel also increases the mechanical work required to the raise the body and execute each succeeding stride, thus make walking and running more difficult and tiring. The lowered heel will also increase the wearer's response time and alters his balance, adversely affecting athletic performance.

Figures 4, 4A:
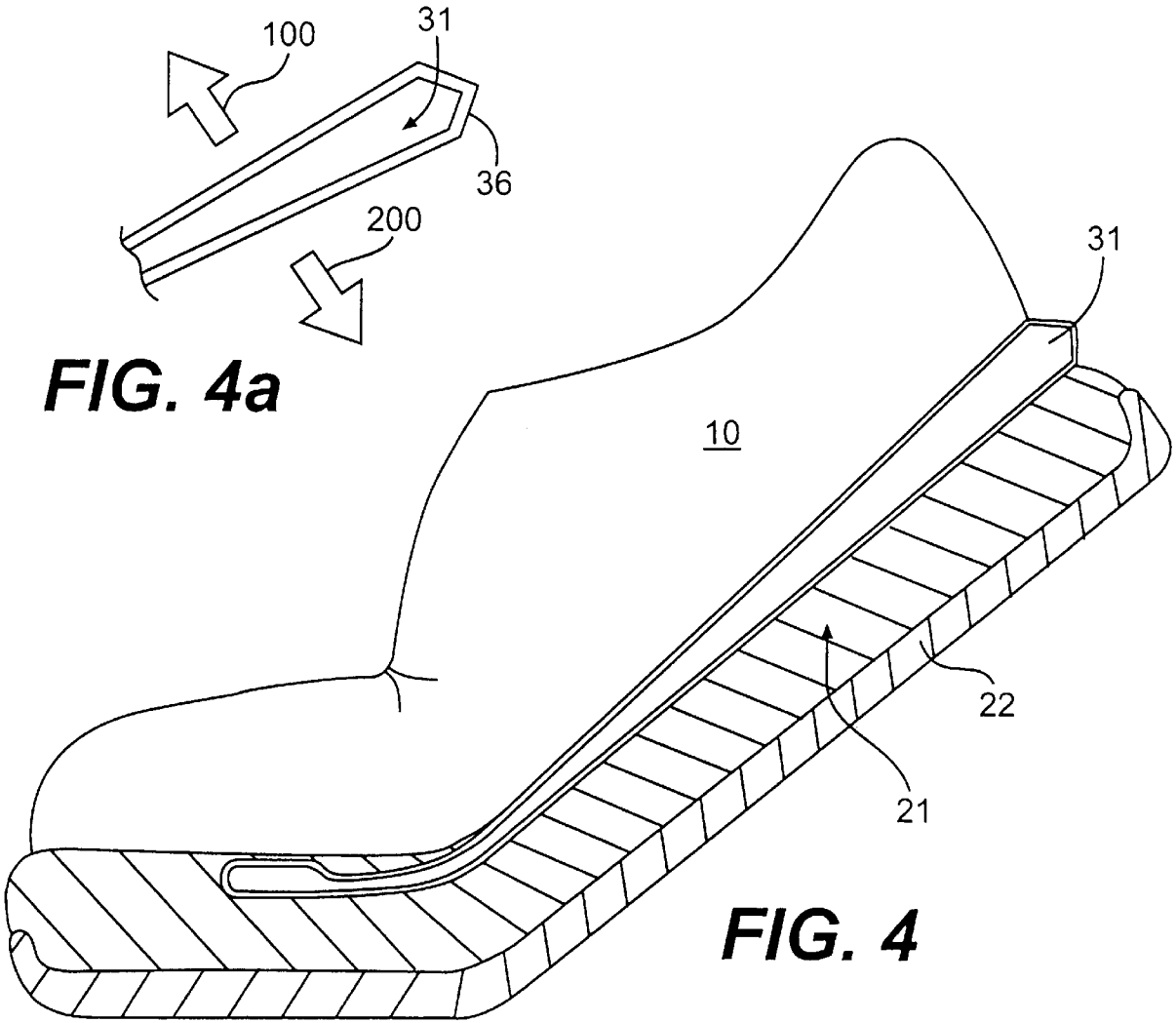
FIG. 4 illustrates the expanded nature of the pumping chamber during the flexion part of the stride and the tension force vectors that inflate the pumping chamber.
FIG. 4*a* is a schematic drawing of the pumping chamber showing the directions of tension forces exerted on the top and bottom surfaces of the pumping chamber.

The present invention utilizes the mechanical forces associated with the flexion of the footwear to reinflate pumping chamber 31. As shown in FIG. 4, during part of a normal walking or running stride, the foot is bent as the wearer rolls his weight onto his toes and lifts the heel of the footwear off the ground. As the wearers foot bends upward, all compression forces in the heel region are eliminated. They are replaced by tension forces as the foot pulls the footwear upward. These tension forces are translated perpendicularly to the outsole 22 through the bond between foot-enclosing upper 10 and midsole 21. Pumping chamber 31 is positioned so that these tension forces reinflate it completely. FIG. 4-*a* shows the tension forces during flexion. Upper 10 and lasting board 40, if used, exert an upward force 100 on the top surface of pumping chamber 31. The bending resistance of outsole 22 and midsole 21 opposes the flexion with a downward force 200 on the bottom surface of pumping chamber 31. The net effect of these opposing tension forces is to reinflate pumping chamber 31 as shown in FIG. 4.

If the sole assembly is stiff, or if the flexion is large, tension forces 100 and 200 may be large enough to straighten peripheral walls 36 and thereby enlarge the volume of pumping chamber 31 beyond its nominal capacity. Thus the primary chamber reinflation forces of the present invention are the result of foot flexion. It is therefore unnecessary to incorporate any additional devices such as a spring to reinflate as disclosed in the prior art. Any natural resilience of peripheral walls 36 of the present invention supplements the tension forces that reinflate pumping chamber 31.

During the push-off phase of walking or running the foot flexes between the metatarsus and phalanges, a point approximately 60% forward of the heel. Footwear are often designed to provide a flex zone or hinge in this region to ease the effort of walking or running. The flex zone is subject to repeated deformations and forces that could pinch and kink pumping chamber 31. Therefore, it may be desirable to terminate pumping chamber 31 to the rear of the flex zone, i.e., it would be less than 60% of its length of the incorporating sole unit.

The tapered or wedge-shape of pumping chamber 31 is consistent with the shape of the space that would naturally form as foot-enclosing upper 10 pulls away from midsole 21 during flexion. Consequently tension forces 100 and 200 from foot flexion are uniformly distributed across the entire upper and lower surfaces of pumping chamber 31, respectively. A further advantage of this method of chamber reinflation is that the wearer can actuate the pump even while sitting. All that is required is a simple heel to toe rocking motion.

The ventilation system of the present invention also incorporates at least two one-way valves 33 and 35 to control airflow into and out pumping air chamber 31. In the most preferred embodiment, valves 33 and 35 are arranged so that air enters into pumping chamber 31 from the footwear interior, preferably from under the bridge of the toes region, and then exhausts out of pumping chamber 31 to the footwear exterior. As shown in FIG. 1, inlet valve 35 is connected to pumping chamber 31 by internal air duct 34. Outlet valve 33 is connected to pumping chamber 31 by external air vent 32. External air vent 32 and outlet valve 33 may be mounted directly on peripheral walls 36 of pumping chamber 31 or in a separate duct between pumping chamber and the exterior environment. In the former case, it is important that outlet valve 33 be positioned so as not to interfere with the collapse of peripheral walls 36 of pumping chamber 31. In a less preferred configuration the directionality of valves 33 and 35 can be configured so as to draw outside air into pumping chamber 31 and exhaust it into the footwear. This configuration is preferred for cold climates because cold air from the footwear exterior is heated due to compression of the pumping chamber before entering the interior of the footwear.

Figure 5A:
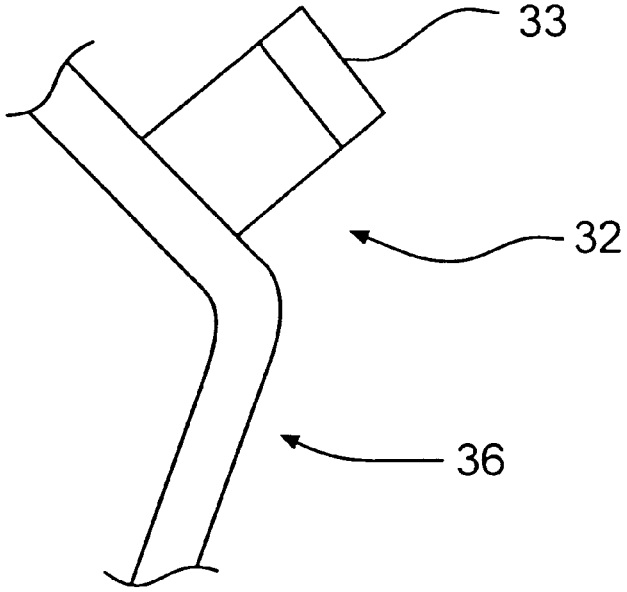
FIG. 5-*a* illustrates a preferred exterior air vent placement so as not to hinder the collapse of the pumping chamber.
Figure 5B:
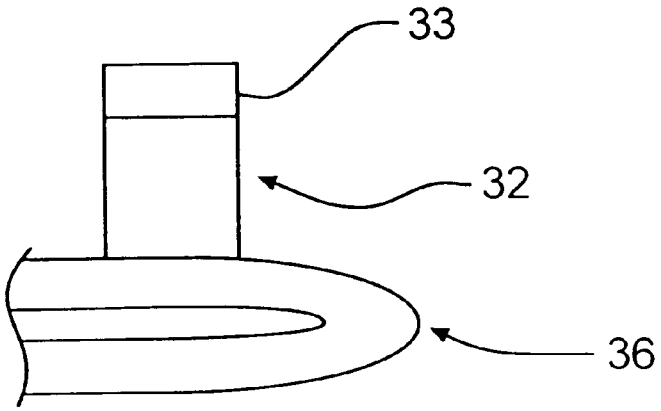

FIG. 5-*a* illustrates the placement of external air vent 32 and outlet valve 33 on peripheral walls 36 of pumping chamber 31. External air vent 32 and outlet valve 33 are preferably positioned on either the upper or lower sloping face of peripheral walls 36. In these locations, external air vent 32 and outlet valve 33 tilt as peripheral walls 36 fold. External air vent 32 and outlet valve 33 do not interfere with the collapse of pumping chamber 31. Placement of external air vent 32 and outlet valve 33 at the "elbow" of peripheral walls 36 will inhibit chamber collapse and creates regions of very high stress and potential failure. An alternate placement of external air vent 32 and outlet valve 33 is between pumping chamber 31 and the flex zone. This positioning has the virtue of placing external air vent 32 and outlet valve 33 in the region of the footwear least subject to stress and pressure. In this position peripheral walls 36 do not normally flex, so the aforementioned folding action does not occur. It may be desirable to have more than one external air vent 32 and more than one outlet valve 33 to reduce air pressure built up in pumping chamber 31.

A still further advantage of the present invention over the prior art is the ease with which a large volume air chamber can be utilized. The volume of air exchanged with each stride has a significant impact on the perceived level of cooling. For a U.S. size 9 men's footwear, air volumes less than 40 cc give little noticeable cooling. With the same footwear, the cooling effect becomes quite noticeable when pumped air volumes exceed about 65 cc. According to the prior art of U.S. Pat. No. 5,515,622, the maximum workable chamber that can be incorporated into the heel of a U.S. size 9 men's'footwear is only 20 cc. Utilizing the present invention, however, a pumping chamber with approximately 120 cc volume can be easily incorporated into a U.S. size 9 men's footwear. The expected volume would decrease approximately 3% for each decrease in shoe size.

The preceding description of the present invention has assumed that the ventilated footwear is an athletic footwear with a sole assembly composed of relatively thick, cushioning midsole, usually EVA or polyurethane foam, and thin hard rubber tread or outsole. The structure of the sole assembly is the primary determinant of the footwear's cushioning and shock absorbing character but it has little impact on the functioning of the ventilation system of the present invention. Consequently, unlike many prior art systems that rely on the resilience of the foam sole to drive the reinflation of the air chamber, the present invention will function equally well with hard or soft soles.

It will be obvious to those skilled in the art that many modifications to present invention are possible. In a less preferred embodiment, for example, the heel of the midsole could be split laterally where the wedge-shaped pumping chamber could be inserted into the slit. In another embodiment the upper and/or lower surfaces of the pumping chamber may be cupped and fitted into a matching depression in the midsole. Under compression the heel will then rest in a shallow cup-like depression which provides more uniform pressure distribution across the pumping chamber. This in turn results in greater wearer comfort and also provides a stabilizing centering force to the wearer. The stabilizing force resists possibly damaging ankle twisting.

What I claim is:

1. A self-ventilated footwear having a heel and a flex zone comprising:

(a) an outsole having a first length dimension;

(b) a cushioning midsole immediately above the outsole attached directly to the outsole;

(c) a wedge-shaped pumping chamber, with its maximum thickness towards the rear, said pumping chamber tapering forward to a minimum thickness in front of the footwear's heel and behind the footwear's flex zone, wherein said pumping chamber is attached to the midsole immediately above the midsole;

(d) an internal air duct fluidly connected to the pumping chamber leading forward from the pumping chamber past the flex zone to a one-way inlet valve that allows air to enter the pumping chamber through the internal air duct;

(e) a one-way outlet valve that allows air to exit the pumping chamber through an external air vent; and (f) a foot-enclosing upper attached to the pumping chamber above the pumping chamber, wherein the internal air duct and the inlet valve fit in a channel in the midsole.

2. The footwear of claim 1, further comprising a lasting board inserted between the pumping chamber and the foot-enclosing upper.

3. The footwear of claim 1, wherein the pumping chamber has a second length dimension that is at least 30% but less than 60% of the first length dimension of the outsole.

4. The footwear of claim 1, wherein the pumping chamber has a volume that exceeds 100 cc.

5. The footwear of claim 1, wherein the lower surface of the pumping chamber is flat and horizontal.

6. The footwear of claim 1, wherein the pumping chamber is symmetrical so that the same pumping chamber can be used to make both left and right footwear.

7. The footwear of claim 1, wherein the pumping chamber has peripheral walls, and wherein the peripheral walls of the pumping chamber are elbow-shaped.

8. The footwear of claim 7, wherein the outlet valve is located on the peripheral walls of the pumping chamber on one of the upper and lower sloping portions of the peripheral walls.

9. The footwear of claim 1, wherein the pumping chamber has peripheral walls, and wherein the peripheral walls of the pumping chamber form a curved concavity.

10. The footwear of claim 1, wherein the pumping chamber has peripheral walls, and wherein the peripheral walls provide minimal resistance to compression of the pumping chamber.

11. A ventilating system for a footwear with a toe region, a heel, a flex zone, a midsole, and a foot-enclosing upper comprising:

(a) a unitary blow-molded pumping chamber with a front end and a rear end, said pumping chamber having a wedge-shaped longitudinal cross-section which tapers from the rear end towards the front end of the pumping chamber;

(b) an internal air duct fluidly connected to the pumping chamber at the front end and extending forward toward the toe region of the footwear;

(c) an external air vent fluidly connected to the pumping chamber along its periphery and extending toward the exterior of the footwear;

(d) a one-way air inlet valve fluidly connected to the internal air duct to control air flow within the foot-enclosing upper and the pumping chamber; and (e) a one-way air outlet valve fluidly connected to the external air vent to control air flow out of the pumping chamber, wherein the ventilating system is positioned above the midsole and below the foot-enclosing upper of the footwear, wherein the internal air duct and the inlet valve fit in a channel in the midsole.

12. The system of claim 11, wherein the longitudinal cross-section of the pumping chamber is essentially wedge-shaped, tapering from a maximum height at the rear end of the pumping chamber to a minimum height prior to the footwear's flex zone.

13. The system of claim 11, wherein the footwear has a first length dimension, and wherein the pumping chamber has a second length dimension that is at least 30% but less than 60% of the first length dimension of the footwear.

14. The system of claim 11, wherein the pumping chamber has a volume that exceeds 100 cc.

15. The system of claim 11, wherein the lower surface of the pumping chamber is flat and horizontal.

16. The system of claim 11, wherein the pumping chamber is symmetrical such that the same pumping chamber can be turned upside down to change it from a left-foot system to a right-foot system, and vice-versa.

17. The system of claim 11, wherein the pumping chamber has peripheral walls, and wherein the peripheral walls of the pumping chamber are elbow-shaped.

18. The system of claim 17, wherein the pumping chamber has peripheral walls, and wherein the outlet valve is located on the peripheral walls of the pumping chamber on one of the upper and the lower portions of the peripheral walls.

19. The system of claim 11, wherein the pumping chamber has side walls, and wherein the side walls of the pumping chamber are elbow-shaped.

20. A self-ventilated footwear having a front portion, a rear portion, a toe region, a bridge-of-the-toe region, and a flex zone comprising:

(a) an outsole;

(b) a cushioning midsole immediately above the outsole attached directly to the outsole;

(c) a wedge-shaped pumping chamber, with its maximum thickness towards the rear portion tapering forward to a minimum thickness forward of the footwear's heel and rearward of the footwear's flex zone immediately above the midsole attached to the midsole;

(d) an internal air duct fluidly connected to the pumping chamber leading forward from the pumping chamber past the flex zone to a one-way inlet valve that allows air to enter the pumping chamber through the internal air duct;

(e) a one-way outlet valve that allows air to exit the pumping chamber through an external air vent;

(f) a lasting board covering the pumping chamber, the internal air duct, and the midsole, and (g) a foot-enclosing upper attached to the lasting board above the lasting board, wherein the lasting board has a first opening immediately above the inlet valve, and wherein the first opening on the lasting board is covered by a first filtration device such as an open cell foam or a mesh fabric, and wherein a foam insole is placed inside the foot-enclosing upper, wherein the foam insole has a second opening immediately above the first opening of the lasting board, and wherein a second filtration device such as an open cell foam or a mesh fabric covers the second opening on the form insole.

21. The footwear of claim 20, wherein the inlet valve is located near the toe region or the bridge-of-the-toe region of the footwear.

22. The footwear of claim 20, wherein the lasting board has an opening immediately above the inlet valve, and wherein such opening on the lasting board is covered by a filtration device such as an open cell foam or a mesh fabric.

23. The footwear of claim 20, wherein the lasting board is formed from stiffened cardboard.

24. The footwear of claim 20, wherein the lasting board is formed from a plastic such as polypropylene.

* * * * *